United States Patent [19]

Adkison et al.

[11] 4,149,581

[45] Apr. 17, 1979

[54] FINE PARTICLE RECYCLING METHOD AND APPARATUS

[75] Inventors: B. Wayne Adkison, Matthews; T. Earl Burden, Charlotte, both of N.C.

[73] Assignee: Cole Manufacturing Company, Charlotte, N.C.

[21] Appl. No.: 790,186

[22] Filed: Apr. 25, 1977

[51] Int. Cl.[2] ..... B22C 5/00

[52] U.S. Cl. ..... 164/5

[58] Field of Search ..... 164/5; 55/244, 86; 259/5, 6

[56] References Cited

U.S. PATENT DOCUMENTS

| | | | |
|---|---|---|---|
| 2,668,754 | 2/1954 | Lichtenfels | 55/86 X |
| 2,783,511 | 3/1957 | Will et al. | 164/5 X |
| 3,256,573 | 6/1966 | Hunter | 259/5 X |
| 3,604,493 | 9/1971 | Schumacher | 164/5 |
| 3,884,651 | 5/1975 | Velegol | 55/86 |

FOREIGN PATENT DOCUMENTS

| | | | |
|---|---|---|---|
| 108475 | 3/1976 | Japan | 164/5 |

*Primary Examiner*—Richard B. Lazarus

*Attorney, Agent, or Firm*—Bell, Seltzer, Park & Gibson

[57] ABSTRACT

A foundry apparatus and a method of operating a foundry in which molding material is prepared by mixing sand and water in a muller, formed into molds for sand casting of metals, and later recycled. In accordance with the present invention, fine particles of molding material are removed as a wet waste, which is subsequently delivered to the muller for mixing with sand and water in preparing molding material.

15 Claims, 2 Drawing Figures

FINE PARTICLE RECYCLING METHOD AND APPARATUS

Figure 1:
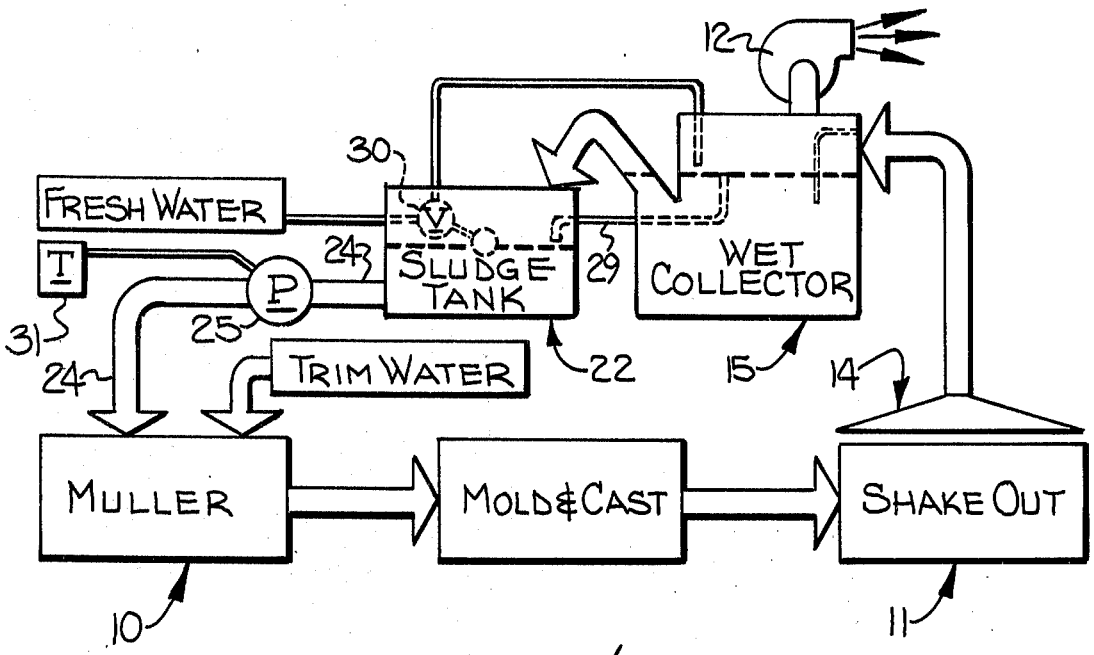

Metal foundries, and particularly iron foundries, have long followed procedures based on so-called "sand casting" techniques. In accordance with such techniques, metal castings are formed by pouring molten metal into a mold formed by packing sand closely around a pattern and then removing the pattern. As such technology has advanced, desired casting characteristics have been sought by selecting the characteristics of the molding material used to form the molds. Such molding materials commonly contain not only sand but significant additives for the sand such as clay, resins and the like.

In the operation of contemporary sand casting foundries, material for the formation of molds is prepared by mixing sand, appropriate additives, and water in a mixing apparatus which is herein referred to as a "muller". Prepared molding material is delivered to be formed into molds, into which metal is then cast. Following casting, the rough castings are "shaken out" to separate the casting from most of the molding material, and the molding material is largely recycled.

Foundry operation has long been recognized as presenting potential hazards for foundry workers, in part due to dust and the like arising from molding material handling processes including shake out of rough castings. For these reasons, it has become conventional to provide pollution control means for gathering, from a foundry, airborne fine particles otherwise presenting hazards to workers.

Heretofore, the gathering of airborne fine particles has presented further difficulties in that increasingly stringent requirements for air quality have prohibited direct emission of the airborne fine particles into an ambient atmosphere. One approach to disposal of such fine particles which has achieved wide acceptance has been to wash such particles out of an air flow and discard the particles as a wet waste. It has been assumed that the fine particles and wet waste have not been useful and, in fact, disposal of such wet waste has presented an increasinly difficult problem. Foundry sludge is difficult to handle and transport, and is deemed unacceptable by many operators of land fills and other normal disposal areas.

In light of the prior practices and the deficiencies thereof as recognized hereinabove, it is an object of the present invention to provide, in a foundry having certain conventional apparatus, an improvement which recycles fine particles removed from the foundry operation as wet waste. In realizing this object of the present invention, wet waste removed from the foundry is delivered to a muller for mixing with sand and water in preparing molding material for subsequent use.

Yet a further object of this invention is to operate a foundry in accordance with a method in which wet waste formed in a wet scrubber from fine particles removed from a foundry by entrainment in an airflow is delivered to a muller to supply the major portion of liquid required for mixing with sand in preparing molding material. In realizing this object of the present invention, disposal difficulties are avoided by recycling of the material which heretofore has presented such difficulties.

Some of the objects having been stated, other objects will appear as the description proceeds, when taken in connection with the accompanying drawings, in which—

Figure 2:
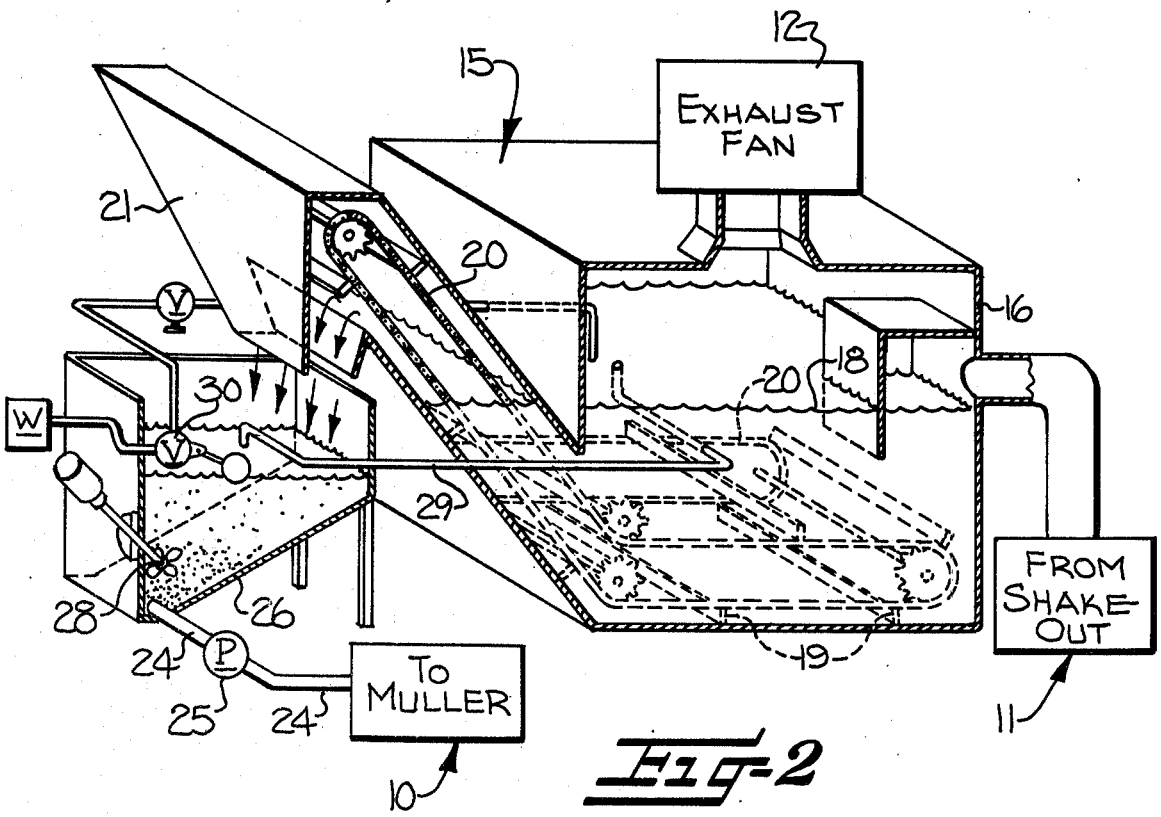

FIG. 1 is a schematic representation of apparatus incorporating the present invention, particularly illustrating the sequence of steps involved in the operation of a foundry incorporating the present invention; and FIG. 2 is a partly schematic, partly perspective view of portions of apparatus embodying the present invention.

While this invention will be described more particularly hereinafter with reference to the accompanying drawing, it is to be understood at the outset of this description that it is contemplated that persons skilled in the applicable arts may be able to depart from the specific arrangements shown and described while achieving the desired result of this invention. Accordingly, the description and accompanying drawing are to be taken as a broad teaching of this invention, and not as restrictive of the scope of protection afforded for this invention.

Referring now more particularly to FIG. 1, it has been conventional to provide, in the operation of a foundry, for the preparation of molding material by mixing sand and water within a muller, here generally indicated at 10. The specific details of the muller means 10 have not been here disclosed, as detailed information concerning such apparatus is available to interested readers from prior patents and from manufacturers of commercially available foundry equipment. Molding material prepared in the muller by mixing sand, appropriate additives and water, is delivered to appropriate personnel and/or mechanism for forming of molds and casting of metal. From the pouring location, molds containing rough castings are delivered to a shake out location here generally indicated at 11, at which the rough castings and molding material are separated.

Due to the quantities of airborne particles created in the foundry operation, and frequently particularly at a shake out location 11, it is common to provide pollution control means within a foundry for removing airborne fine particles. In the form illustrated, the pollution control means includes means for inducing airflow in the form of an exhaust fan 12. The exhaust fan 12 operatively communicates with suitable enclosures and/or hood means within the foundry, such as a hood generally indicated at 14 which may be located over or adjacent a shake out location 11. By means of an airflow induced through the hood 14 by the exhaust fan 12, airborne fine particles of molding material are entrained and removed from within the foundry.

Air and entrained fine particles thus removed from a foundry are conventionally delivered to a wet collector, here generally indicated at 15. Wet collector means such as the apparatus 15 are generally well-known to persons operating foundries and other establishments subject to air pollution control regulations and may tion of such means. It is sufficient for purposes of the present invention to note that one form of such a wet collector means 15, as indicated in FIG. 2, may include a housing 16 constructed as a substantially closed tank containing a body of water 18. Air drawn from within the foundry is forced to pass through the water 18 within the housing 16, for removal of entrained, airborne fine particles therefrom. Such removed fine particles eventually settle toward the bottom of the housing 16 to form a sludge deposit thereupon. The sludge deposit is removed from the wet collector 15, in the form shown, by a series of scraper bars 19 mounted upon driven chains (one of which is visible at 20 in FIG. 2) and extending transversely of the housing 16. By means of the scraper bars 19, sludge is withdrawn from the bottom of the housing 16, raised to a discharge chute 21, and discharged from the wet collector 15.

In accordance with the present invention, recirculating means are provided which operatively communicate with the scrubber means 15 for receiving wet waste therefrom and operatively communicate with the muller means 10 for delivering wet waste thereto for mixing with sand. By such recycling of fine particles, the disposal problems heretofore encountered are obviated without degrading the quality of the molding material used or the castings made. More particularly, a sludge tank 22 is, in the illustrated embodiment, disposed beneath the discharge chuts 21, for receiving wet waste from the collector 15. By means of a discharge conduit 24 and pump means 25 such as an air-driven diaphragm pump, liquid and wet waste from the sludge tank 22 is delivered into the muller means 10. Preferably, and in the form shown, the sludge tank 22 has a bottom wall 26 which slopes toward the location from which the conduit 24 leads. Additionally, it is preferred to provide agitating means in the form of a motor driven propeller 28 or the like disposed within the sludge tank 22 for maintaining suspension of fine particles in liquid contained therewithin. Sludge discharged from the wet colletor 15 is diluted within the sludge tank 22 and maintained in suspension prior to delivery to the muller means 10.

In order to achieve a desired dilution of wet waste from the wet collector 15, and in the particular form shown, water is delivered from the wet collector 15 to the sludge tank 22. More particularly, the wet collector 15, in the form shown, is of a type wherein the desired water level within the wet collector is maintained by a constant overflow from within the housing 16 through an overflow conduit 29 (FIG. 1). In accordance with the present invention, fresh water (from any suitable source such as a city water supply) is supplied to the wet collector 15 by a float valve 30 responsive to water levels within the sludge tank 22. That is, should pumping of diluted wet waste from the sludge tank 22 lower the water level of that tank below the level maintained by the normal overflow from the wet collector 15, then additional water is added through the wet collector to restore the sludge tank water level.

In operating a foundry having apparatus in accordance with the present invention, wet waste is delivered from the sludge tank 22 by the pump 25 upon preparation of a batch of molding material in the muller 10. Preferably, the quantity of diluted wet waste supplied to the muller 10 is controlled by a timer 31 operatively connected with the pump 25 and causing operation of the pump 25 for an interval of time sufficient to deliver a quantity of liquid less than the entire quantity necessary for preparation of a batch of molding material. Typically, the liquid provided from the sludge tank 22 may be on the order of 75 to 90% of the liquid required for preparation of a batch of molding material. Provision is made for the addition of trim water from a suitable source such as a city water supply under the manual control of an operator or otherwise as may be necessary or appropriate to make up the exact quantity of water required from preparation of the batch of molding material.

Experience with an operating installation of equipment operated in accordance with the methods of this invention has demonstrated the advisibility of some provision for back flushing the conduit 24 periodically, in order to assure that the pump 25 and conduit 24 are not clogged by fine particles which have settled out therewithin. In that installation, the casting quality of the molding material is not degraded by recirculation of fine particles, as corresponding quantiities of more coarse particles (or sand) are removed from the molding material which is recycled through normal foundry operation.

In the drawings and specification, there has been set forth a preferred embodiment of the invention, and although specific terms are employed, they are used in a generic and descriptive sense only and not for purposes of limitation.

That which is claimed is:

1. In a foundry having muller means for preparing molding material by mixing sand and water, and means for removing fine particles of molding material from the foundry as wet waste, the improvement comprising recirculating means operatively communicating with said fine particle removing means for receiving waste therefrom and operatively communicating with said muller means for delivering waste thereto for mixing with sand, whereby fine particles are recycled into the foundry and the need for otherwise disposing of fine particle waste is alleviated.

2. Apparatus according to claim 1 wherein said recirculating means comprises tank means operatively communicating with said pollution control means for receiving waste therefrom, and pump means operatively communicating with said tank means and said muller means for controllably pumping waste from said tank means to said muller means.

3. Apparatus according to claim 2 and further comprising timer means operatively connected with said pump means for controlling intervals of operation thereof.

4. Apparatus according to claim 2 and further comprising means operatively communicating with said tank means for delivering thereinto water for forming a solution with waste received from said pollution control means prior to pumping thereof to said muller means.

5. In a foundry having muller means for preparing molding material by mixing sand and water, air circulating means for inducing an airflow and entraining fine particles of molding material in the airflow, and scrubber means for removing entrained fine particles from the airflow as wet waste, the improvement comprising recirculating means operatively communicating with said scrubber means for receiving wet waste therefrom and operatively communicating with said muller means for delivering wet waste thereto for mixing with sand, whereby fine particles entrained in the airflow are recycled into the foundry and the need for otherwise disposing of wet waste is alleviated.

6. Apparatus according to claim 5 wherein said recirculating means comprises tank means for receiving wet waste, dilution water delivery means for delivering into said tank means water for diluting wet waste contained therein, and agitator means for agitating water and wet waste contained in said tank means and thereby for maintaining fine particles in suspension therein.

7. Apparatus according to claim 5 wherein said recirculating means comprises tank means for receiving wet waste and overflow water from said scrubber means, and further comprising water supply means operatively responsive to the water level in said tank means for supplying water to said scrubber means for overflow into said tank means.

8. In a method of operating a foundry which includes preparing molding material by mixing sand and water in a muller, removing fine particles of molding material by inducing an airflow within the foundry while entraining fine particles of molding material in the airflow, passing the airflow through a wet scrubber and forming the entrained fine particles into wet waste, and dredging wet waste from the scrubber, the improvement comprising delivering wet waste from the scrubber to the muller for mixing with sand and water.

9. A method according to claim 8 further comprising controlling the fine particle content of the molding material by removing a portion of coarse particles otherwise recycled.

10. A method according to claim 8 further comprising forming a solution with the waste before delivering the same to the muller.

11. A method according to claim 10 further comprising agitating the waste solution for maintaining the waste in suspension before delivery thereof to the muller.

12. A method according to claim 10 wherein the step of delivering waste to the muller comprises delivering a quantity of waste solution less than the quantity of liquid required for mixing with sand, and further comprising adding trim water to the muller to adjust the quantity of liquid delivered to that required.

13. A method according to claim 8 wherein the step of delivering wet waste comprises collecting wet waste in a tank, and periodically pumping wet waste from the tank to the muller.

14. A method according to claim 13 further comprising timing periods of pumping of wet waste for delivering to the muller wet waste in quantities less than the quantities of liquid required for mixing with sand.

15. A method according to claim 13 further comprising sensing liquid levels in the tank, responding to decreases in liquid level in the tank by adding water to the wet scrubber, and overflowing water from the wet scrubber into the tank.

* * * * *

UNITED STATES PATENT AND TRADEMARK OFFICE

CERTIFICATE OF CORRECTION

PATENT NO. : 4,149,581

DATED : April 17, 1979

INVENTOR(S) : B. Wayne Adkison and T. Earl Burden

It is certified that error appears in the above-identified patent and that said Letters Patent are hereby corrected as shown below:

Column 1, Line 43 "increasinly" should be - increasingly -

Column 2, Line 56 delete "tion" and insert - take a number of specific forms. It is contemplated that the present invention will be useful with any of a variety of commercially available wet collectors and, accordingly, no lengthy discussion will here be given of the construction or operation -

Column 3, Line 16 after the word "discharge" delete chuts and insert therefor - chute -

Column 3, Line 28 "colletor" should be - collector -

Column 4, Line 7 "quantiities" should be - quantities -

Column 5, Line 5 after the word "muller," insert - and -

Signed and Sealed this

*Eleventh* Day of *September 1979*

[SEAL]

*Attest:*

*Attesting Officer*

LUTRELLE F. PARKER

*Acting Commissioner of Patents and Trademarks*